United States Patent [19]

Sasaki et al.

[11] Patent Number: 4,731,320

[45] Date of Patent: Mar. 15, 1988

[54] SILVER HALIDE PHOTOGRAPHIC MATERIAL

[75] Inventors: Masao Sasaki; Toyoki Nishijima; Shun Takada; Takashi Kadowaki; Kaoru Onodera, all of Odawara, Japan

[73] Assignee: Konishiroku Photo Industry Co., Ltd., Tokyo, Japan

[21] Appl. No.: 896,564

[22] Filed: Aug. 13, 1986

Related U.S. Application Data

[63] Continuation of Ser. No. 716,164, Mar. 26, 1985, abandoned.

[30] Foreign Application Priority Data

Mar. 29, 1984 [JP] Japan ..... 59-61555

[51] Int. Cl.[4] ..... G03C 1/40; G03C 1/46

[52] U.S. Cl. ..... 430/505; 430/546; 430/552; 430/553

[58] Field of Search ..... 430/546, 551, 552, 553, 430/505

[56] References Cited

U.S. PATENT DOCUMENTS 4,217,410 8/1980 Nakamura et al. ..... 430/546
4,327,175 4/1982 Toda et al. ..... 430/551
4,407,940 10/1983 Nakamura et al. ..... 430/546
4,451,558 5/1984 Sugita et al. ..... 430/552
4,455,367 6/1984 Seoka et al. ..... 430/553

*Primary Examiner*—Won H. Louie
*Attorney, Agent, or Firm*—Jordan B. Bierman

[57] ABSTRACT

A silver halide photographic material having one or more silver halide emulsion layers formed on a support is disclosed wherein at least one of said silver halide emulsion layers contains at least one cyan coupler of formula (I) dispersed therein with the aid of a high-boiling organic solvent having a dielectric constant of not more than 6.0:

(I)

(wherein $R_1$ is a straight- or branched-chain alkyl group having 2 or 4 carbon atoms; X is a hydrogen atom or a group capable of leaving upon coupling reaction; and $R_2$ is a ballast group).

6 Claims, No Drawings

SILVER HALIDE PHOTOGRAPHIC MATERIAL

This application is a continuation of application Ser. No. 716,164, filed Mar. 26, 1985, now abandoned.

BACKGROUND OF THE INVENTION

The present invention relates to a silver halide photographic material. More particularly, the invention relates to a silver halide photographic material which contains a cyan coupler forming a stable dispersion and which produces a dye image of good keeping quality.

The mechanism behind the formation of dye images in a silver halide color photographic material is that an aromatic primary amine developing agent, while reducing silver halide grains in the exposed photographic material, is oxidized and the resulting oxidized product reacts with a coupler already present in the silver halide color photographic material so as to form a dye. Color reproduction in this case depends commonly on the subtractive process using three couplers which respectively form yellow, magenta and cyan dyes. These couplers are added to silver halide emulsion layers after they are dissolved in a substantially water-soluble high-boiling organic solvent, optionally in combination with an auxiliary solvent.

There are several requirements that must be met by the couplers: first, they must have high solubility in high-boiling organic solvents, and they should be highly dispersible in silver halide emulsions and the prepared dispersion should remain stable without causing the precipitation of the couplers; secondly, the couplers should provide good photographic characteristics; and thirdly, the couplers should produce dye images which are fast to light, heat and moisture.

One important question being raised recently by people in the photographic industry is how to improve the heat and moisture resistance (resistance to dark discoloration) of cyan couplers. Typical known cyan couplers are 2,5-diacylaminophenols having an acylamino group as a substituent on the 2- and 5-positions of the phenol ring, and cyan couplers of this type are shown in U.S. Pat. No. 2,895,826, as well as Japanese Unexamined Published Patent Publication Nos. 112038/1975, 109630/1978 and 163537/1980. Such 2,5-diacylaminophenolic cyan couplers are extensively used since they produce cyan dye images having high resistance to dark discoloration. However, the resistance to light discoloration of the produced dye image is extremely low, and the unreacted cyan coupler is highly likely to turn yellow upon exposure to light (this phenomenon is hereunder referred to as Y stain under light). In an extreme case, this low-density area of the image turns pink upon exposure to light, and this may amplify the visible discoloration of the image.

The use of a benztriazole compound (see, for example, Japanese Unexamined Published Patent Application No. 151149/1975) has been proposed as a means for improving the resistance to light discoloration of 2,5-diacylaminophenolic cyan couplers. However, this benztriazole compound is not suitable for use in practical applications since it has a great tendency to form a precipitate and is only effective against discoloration resulting from exposure to UV radiation. Using an increased amount of a conventional high-boiling organic solvent, such as dibutyl phthalate, is also known. This method is capable of achieving a slight improvement in resistance to light discoloration, but on the other hand, it produces an image with impaired photographic characteristics (e.g. tone) and low resistance to dark discoloration. As a further problem, this method is substantially ineffective in preventing the occurrence of Y stain upon exposure to light.

Japanese Unexamined Published Patent Application No. 173835/1982 proposes a method for providing an improved tone and a light-fast dye, and according to this method, a 2,5-diacylaminophenolic cyan coupler wherein the phenol ring is substituted at 2-position by an ortho-sulfonamidophenylacylamino group is dispersed with the aid of a high-boiling organic solvent having a specified dielectric constant. However, the cyan dye image produced by this method has an appreciably low resistance to light discoloration.

SUMMARY OF THE INVENTION

One object of the present invention is to provide a silver halide photographic material having improved resistance to Y stain under light.

Another object of the present invention is to provide a silver halide photographic material which has no discoloration in the low density area of a cyan dye image under exposure to light.

A further object of the present invention is to provide a silver halide photographic material which has a good balance in resistance to light, heat and moisture and which is capable of forming a dye image that displays a good keeping quality under hot and humid conditions.

Still another object of the present invention is to provide a silver halide photographic material which has an improved resistance to light discoloration without sacrificing its resistance to dark discoloration.

Yet another object of the present invention is to provide a silver halide photographic material which is capable of forming a dye image having improved keeping quality without causing any adverse effects on the photographic characteristics.

A still further object of the present invention is to provide a silver halide photographic material which contains a cyan coupler as dispersed with the aid of a high-boiling organic solvent capable of producing a highly stabilized dispersion, and which therefore causes no precipitation in the cyan coupler dispersion.

The present inventors have found that the stated objects can be accomplished by a silver halide photographic material having one or more silver halide emulsion layers formed on a support, wherein at least one of said silver halide emulsion layers contains at least one cyan coupler of formula (I) dispersed therein with the aid of a high-boiling organic solvent having a dielectric constant of not more than 6.0:

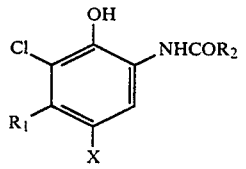

(I)

(wherein $R_1$ is a straight- or branched-chain alkyl group having 2 to 4 carbon atoms; X is a hydrogen atom or a group capable of leaving upon coupling reaction; and $R_2$ is a ballast group).

DESCRIPTION OF THE PREFERRED EMBODIMENT

The symbol $R_1$ in formula (I) represents a straight- or branched-chain alkyl group having 2 to 4 carbon atoms, such as ethyl, propyl or butyl.

The symbol $R_2$ in formula (I) represents a ballast group which is an organic group having such a size and shape that can provide a coupler molecule with sufficient bulkiness to substantially prevents its diffusion from the layer where said coupler is incorporated to another layer. Typical ballast groups are alkyl and aryl groups having a total of 8 to 32 carbon atoms. Such alkyl and aryl groups may have substituents; substituents for aryl groups include alkyl, aryl, alkoxy, aryloxy, carboxy, acyl, ester, hydroxy, cyano, nitro, carbamoyl, carbonamido, alkylthio, arylthio, sulfonyl, sulfonamido, sulfamoyl and halogen, and such substituents excepting alkyl may also be used as substituents for alkyl groups.

Preferred ballast groups are represented by the following formula:

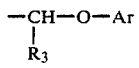

wherein $R_3$ is a hydrogen atom or an alkyl group having 1 to 12 carbon atoms; Ar is an aryl group such as phenyl, which may be substituted by, for example, an alkyl, hydroxy, or alkylsulfonamido, with a branched-chain alkyl group such as t-butyl being preferred.

The symbol X in formula (I) represents a group that leaves upon coupling reaction, and as is well known in the art, such group determines not only the equivalent number of a particular coupler but also the reactivity of the coupling reaction. Typical examples of such group include a halogen represented by chlorine or fluorine, an aryloxy group, a substituted or unsubstituted alkoxy group, an acyloxy group, a sulfonamido group, an arylthio group, a heteroylthio group, a heteroyloxy group, a sulfonyloxy group or a carbamoyloxy group. More specific examples are shown in Japanese Unexamined Published Patent Application Nos. 10135/975, 120334/1975, 130441/1975, 48237/1979, 146828/1976, 14736/1979, 37425/1972, 123341/1975, 95346/1983, Japanese Patent Publication No. 36894/1973, U.S. Pat. Nos. 3,476,563, 3,737,316 and 3,227,551.

Exemplary compounds used as the cyan coupler in the present invention are listed below.

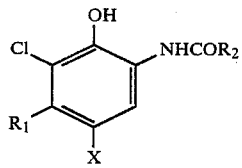

(I)

Exemplary compounds:

| Coupler No. | $R_1$ | X | $R_2$ |
|---|---|---|---|
| 1 | $-C_2H_5$ | $-Cl$ | 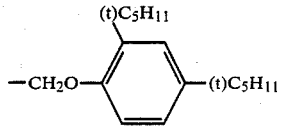 |
| 2 | $-C_2H_5$ | 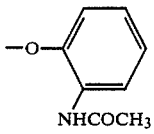 | 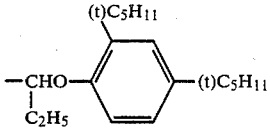 |
| 3 | 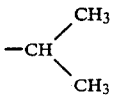 | $-Cl$ | 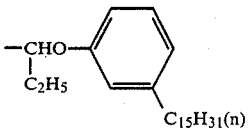 |
| 4 | $-C_2H_5$ | $-Cl$ | 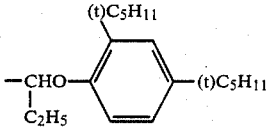 |
| 5 | $-C_2H_5$ | $-Cl$ | 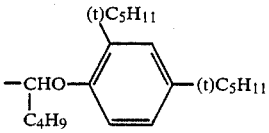 |

-continued
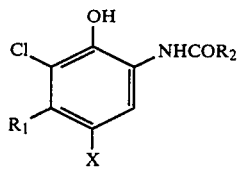
(I)
Exemplary compounds:
| Coupler No. | $R_1$ | X | $R_2$ |
|---|---|---|---|
| 6 | $-C_4H_9$ | $-F$ | 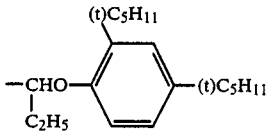 |
| 7 | $-C_2H_5$ | $-F$ | 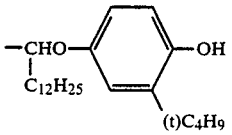 |
| 8 | $-C_2H_5$ | $-Cl$ | 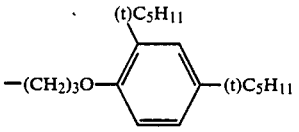 |
| 9 | $-C_2H_5$ | $-F$ | 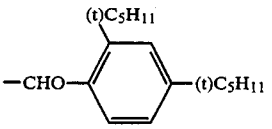 |
| 10 | $-C_4H_9$ | $-Cl$ | 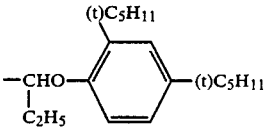 |
| 11 | $-C_2H_5$ | $-Cl$ | 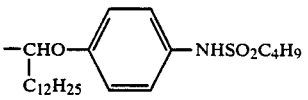 |
| 12 | $-C_2H_5$ | $-Cl$ | 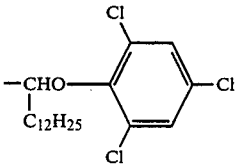 |
| 13 | 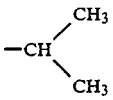 | $-Cl$ | $-C_{18}H_{37}$ |
| 14 | $-C_2H_5$ | $-F$ | 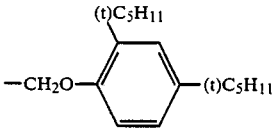 |

-continued

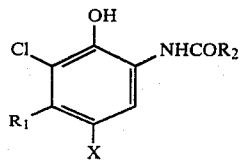

(I)

Exemplary compounds:

| Coupler No. | $R_1$ | X | $R_2$ |
|---|---|---|---|
| 15 | $-C_2H_5$ | 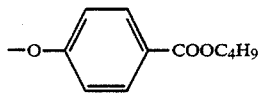 | 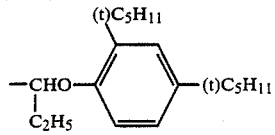 |
| 16 | $-C_2H_5$ | $-Cl$ | 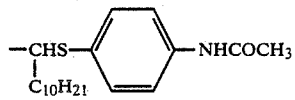 |
| 17 | $-C_3H_7$ | $-Cl$ | 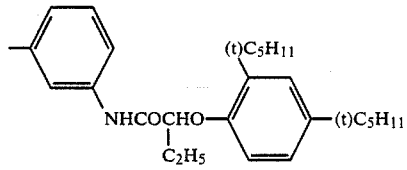 |
| 18 | $-C_3H_7$ | $-Cl$ | 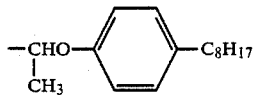 |
| 19 | $-C_2H_4NHCOCH_3$ | $-Cl$ | 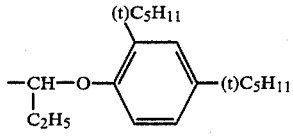 |
| 20 | $-C_3H_6OCH_3$ | $-Cl$ | 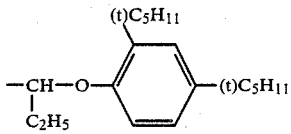 |

Exemplary compound No. 1 as a cyan coupler according to the present invention can be produced by the following method, which may be properly modified and applied to the preparation of other exemplary compounds.

(1)-a: Preparation of 2-nitro-4,6-dichloro-5-ethylphenol

A mixture of 2-nitro-5-ethylphenol (33 g), iodine (0.6 g) and ferric chloride (1.5 g) was dissolved in glacial acetic acid (150 ml). To the resulting solution, 75 ml of sulfuryl chloride was added dropwise at 40° C. over a period of 3 hrs. The precipitate formed during the dropwise addition of sulfuryl chloride was dissolved by refluxing which was effected after completion of the addition. The refluxing was continued for about 2 hrs. The reaction solution was poured into water and the resulting crystal was purified by recrystallization from methanol. The crystal was identified as compound (1)-a by NMR and elemental analyses.

(1)-b: Preparation of 2-amino-4,6-dichloro-5-ethylphenol

Compound (1)-a (21.2 g) was dissolved in 300 ml of alcohol. A catalytic amount of Raney nickel was added to the solution and hydrogen was bubbled into the solution at atmospheric pressure until the absorption of hydrogen ceased. After completion of the reaction, the Raney nickel was removed and the alcohol was distilled off under vacuum. The residual (1)-b compound was subjected to the subsequent acylation without purification.

(1)-c: Preparation of 2-[(2,4-di-tert-amylphenoxy)acetamido]-4,6-dichloro-5-ethylphenol The crude amino compound (1)-b (18.5 g) was dissolved in a liquid mixture of glacial acetic acid (500 ml) and sodium acetate (16.7 g). To the resulting solution was added dropwise a solution of 2,4-di-tert-aminophenoxyacetic acid chloride (28.0 g) in acetic acid (50 ml) at room temperature over a period of 30 minutes. Following stirring for an additional 30 minutes, the reaction solution was poured into iced water. The resulting crystal was recovered by filtration and dried. Two recrystallizations with acetonitrile gave the end compound. It was identified as (1)-c by elemental and NMR analyses.

| Elemental analysis for $C_{21}H_{35}NO_3Cl_2$ | | | | |
|---|---|---|---|---|
| | C | H | N | Cl (%) |
| Calculated: | 65.00 | 7.34 | 2.92 | 14.76 |
| Found: | 64.91 | 7.36 | 2.99 | 14.50 |

The cyan couplers of formula (III) according to the present invention may be used in combination with known cyan couplers so long as they do not interfere with the purposes of the invention.

The cyan coupler of formula (I) according to the present invention is incorporated in a silver halide emulsion layer in an amount which usually ranges from about 0.05 to 2 mols, preferably 0.1 to 1 mol, per mol of silver halide.

Any compound that has a dielectric constant not higher than 6.0 can be used as the organic solvent for preparing a stable dispersion of the cyan coupler of formula (I). Suitable examples are esters such as phthalate and phosphate, organic acid amides, ketones and hydrocarbons having dielectric constants not higher than 6.0. Preferred organic solvents are those which boil at high temperatures (vapor pressure not higher than 0.5 mmHg) and which have dielectric constants not higher than 6.0 and not below 1.9. More preferred are phthalate and phosphate esters having such properties. The organic solvents shown above may be used either alone or in admixture, and when they are used in admixture, the requirements for the dielectric constant not to exceed 6.0 needs to be satisfied by the mixture. The term dielectric constant as used herein means one measured at 30° C.

The phthalate esters that can be used as organic solvents in the present invention are represented by formula (II):

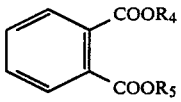

(II)

wherein $R_4$ and $R_5$ are each an alkyl group, an alkenyl group or an aryl group, provided that the total number of carbon atoms in $R_4$ and $R_5$ is from 8 to 32, with the number of 16 to 24 being preferred.

The alkyl groups represented by $R_4$ and $R_5$ in formula (II) are straight- or branched-chain alkyl groups and include such groups as butyl, pentyl, hexyl, heptyl, octyl, nonyl, decyl, undecyl, dodecyl, tridecyl, tetradecyl, pentadecyl, hexadecyl, heptadecyl and octadecyl. The aryl groups represented by $R_4$ or $R_5$ include such groups as phenyl and naphthyl. The alkenyl groups represented by $R_4$ or $R_5$ include such groups as hexenyl, heptenyl and octadecenyl. Each of these alkyl, alkenyl and aryl groups may have one or more substituents. Illustrative substituents for the alkyl and alkenyl groups include a halogen atom, an alkoxy group, an aryl group, an aryloxy group, an alkenyl group and an alkoxycarbonyl group. Exemplary substituents for the aryl group include a halogen atom, as well as alkyl, alkoxy, aryl, aryloxy, alkenyl and alkoxycarbonyl groups. Two or more of these substituents may be introduced into the alkyl, alkenyl or aryl group.

The phosphate esters that can be used as organic solvents in the present invention are represented by formula (III):

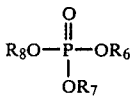

wherein $R_6$, $R_7$ and $R_8$ are each an alkyl group, an alkenyl group or an aryl group, provided that the total number of carbon atoms in $R_6$, $R_7$ and $R_8$ is from 24 to 54.

The alkyl groups represented by $R_6$, $R_7$ and $R_8$ in formula (III) include, for example, butyl, pentyl, hexyl, heptyl, octyl, nonyl, decyl, undecyl, dodecyl, tridecyl, tetradecyl, pentadecyl, hexadecyl, heptadecyl, octadecyl and nonadecyl. Each of the alkyl, alkenyl and aryl groups may have one or more substituents. In a preferred embodiment, each of $R_6$, $R_7$ and $R_8$ is such an alkyl group as 2-ethylhexyl, n-octyl, 3,5,5-trimethylhexyl, n-nonyl, n-decyl, sec-decyl, sec-dodecyl and t-octyl.

Specific examples of the organic solvents that can be used in the present invention are listed below, to which the scope of the invention is by no means limited.

Exemplary compounds:

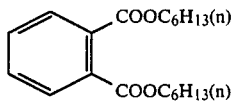

H-1

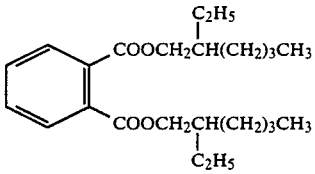

H-2

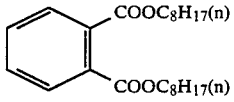

H-3

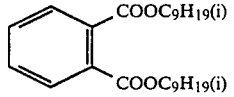

H-4

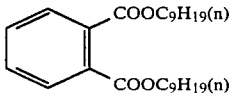

H-5

-continued

Exemplary compounds:

H-6

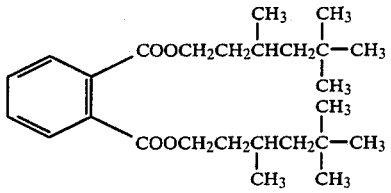

H-7

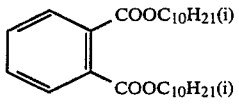

H-8

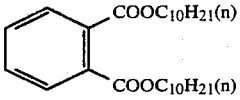

H-9

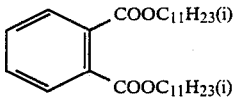

H-10

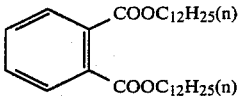

H-11

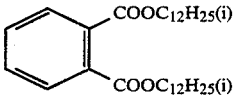

H-12

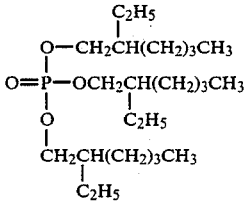

H-13

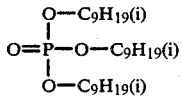

H-14

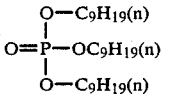

H-15

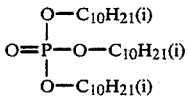

H-16

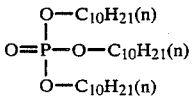

-continued

Exemplary compounds:

H-17

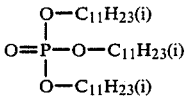

H-18

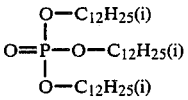

H-19

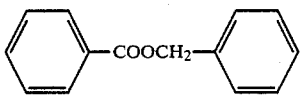

H-20

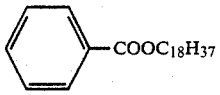

H-21

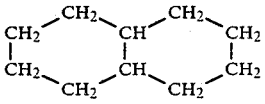

H-22

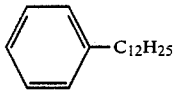

These organic solvents are used in proportions of 25–150 wt%, preferably 50–100 wt%, of the cyan coupler of the present invention.

The cyan coupler used in the present invention may be used in combination with any high-boiling organic compound having a dielectric constant of not higher than 6.0. Preferably, the cyan coupler is combined with the compound of formula (II) or (III).

The silver halide photographic material of the present invention may assume any layer arrangement so long as it has at least one silver halide emulsion layer formed on a support. There is no particular limitation either on the number of the silver halide emulsion layers and non-sensitive layers or on the order in which such layers are arranged. Typical examples of the silver halide photographic material of the present invention include color positive or negative films, color papers, color slides and black-and-white sensitive materials using dye images. The photographic material of the present invention is particularly suitable for use as a color paper. Typically, most of the silver halide emulsion layers and non-sensitive layers are formed as hydrophilic colloidal layers containing hydrophilic binders. Such hydrophilic binders are preferably made of gelatin, or gelatin derivatives such as acylated gelatin, guanidylated gelatin, carbamylated gelatin, cyanoethanolated gelatin and esterified gelatin.

Methods used with conventional cyan dye forming couplers can equally be used with the cyan coupler of formula (I) according to the present invention and the high-boiling organic solvent as defined above which has a dielectric constant of not higher than 6.0. A silver halide emulsion layer that contains a dispersion of the coupler according to the present invention as prepared with the aid of the high-boiling organic solvent defined above is formed on a support, thereby providing the intended silver halide photographic material of the present invention.

The silver halide photographic material of the present invention may be used in either monochromatic or multi-color photography. With a multi-color silver halide photographic material, the cyan coupler according to the present invention is usually incorporated in a red-sensitive silver halide emulsion layer, but instead, it may be incorporated in a non-sensitized emulsion layer or an emulsion layer having sensitivity to light in the spectral regions of the three primary colors other than red. Each of the photographic units that are responsible for the formation of dye images in the present invention is made of one or more emulsion layers that have sensitivity to light in certain spectral regions.

Any known method may be used in order to incorporate the cyan coupler of the present invention in an emulsion. An illustrative method is shown below. First, the cyan coupler of the present invention is dissolved in the high-boiling organic solvent defined hereinabove and in a low-boiling organic solvent typified by methyl acetate, ethyl acetate, propyl acetate, butyl acetate, butyl propionate, cyclohexanol, cyclohexane, tetrahydrofuran, methyl alcohol, acetonitrile, dimethylformamide, dioxane, methyl ethyl ketone, methyl isobutyl ketone, diethylene glycol monoacetate, acetylacetone, nitromethane, carbon tetrachloride or chloroform. These high-boiling and low-boiling organic solvents may be used either alone or in combination. Subsequently, the resulting solution is mixed with an aqueous gelatin solution containing a surfactant, and the mixture is emulsified with a stirrer, homogenizer, colloid mill, flow-jet mixer or an ultrasonic disperser. The resulting dispersion is added to a silver halide emulsion for use in the present invention. This process may include a step for removing the low-boiling organic solvent either after or simultaneously with the dispersing step.

The high-boiling organic solvent according to the present invention is combined with the low-boiling organic solvent at a ratio which generally ranges from 1:0.1 to 1:50, preferably from 1:1 to 1:20.

Illustrative surfactants that can be used in the present invention include anionic surfactants such as alkylbenzenesulfonate salts, alkylnaphthalenesulfonate salts, alkylsulfonate salts, alkylsulfate esters, alkylphosphate esters, sulfosuccinate esters and sulfoalkylpolyoxyethylene alkylphenyl ether; nonionic surfactants such as steroid saponin, alkylele oxide derivatives and glycidol derivatives; amphoteric surfactants such as amino acids, aminoalkylsulfonic acids and alkylbetaines; and cationic surfactants such as quaternary ammonium salts. More specific examples of such surfactants are listed in "Kaimen-kassei zai Binran (Handbook of Surfactants)", Sangyo Tosho, 1956 and "Nyukazai, Nyukasochi Kenkyu, Gijutsu Data-shu (Study of Emulsifiers and Emulsifying Machines—Collective Technical Data)", Kagaku-hanronsha, 1978.

The cyan coupler and high-boiling organic solvent according to the present invention may contain other hydrophobic compounds such as hydroquinone derivatives, UV absorbers, anti-discoloration agents and brighteners.

If the silver halide photographic material of the present invention is a multi-color element, the layers necessary for making the photographic element including the image forming units shown above may be arranged in any of the orders known in the art. A typical multi-color silver halide photographic material comprises a support which carriers a cyan dye image forming unit having at least one red-sensitive silver halide emulsion layer containing one or more cyan dye forming couplers (at least one of the cyan dye forming couplers incorporated in the emulsion layer is the cyan coupler represented by formula (I)), a magenta dye image forming unit having at least one green-sensitive silver halide emulsion layer containing at least one magenta dye forming coupler, and a yellow dye image forming unit having at least one blue-sensitive silver halide emulsion layer containing at least one yellow dye forming coupler.

The photographic element may contain additional non-sensitive layers such as a filter layer, an intermediate layer, a protective layer, an anti-halation layer and a subbing layer.

Preferred compounds for use as the yellow dye forming coupler in the present invention have the following formula (IV):

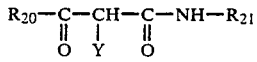

(IV)

wherein $R_{20}$ is an alkyl group (e.g. methyl, ethyl, propyl or butyl), or an aryl group (e.g. phenyl or p-methoxyphenyl); $R_{21}$ is an aryl group; Y is a hydrogen atom or a group that leaves during color development reaction.

Particularly preferred compounds that can be as the yellow dye image forming coupler have the following formula (V):

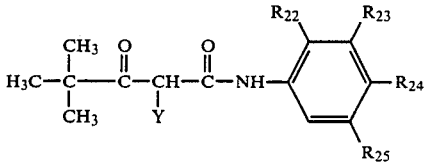

(V)

wherein $R_{22}$ is a halogen atom, an alkoxy or an aryloxy group; $R_{23}$, $R_{24}$ and $R_{25}$ each represents a hydrogen atom, a halogen atom, an alkyl, alkenyl, alkoxy, aryl, aryloxy, carbonyl, sulfonyl, carboxyl, alkoxycarbonyl, carbamyl, sulfon, sulfamyl, sulfonamido, acylamido, ureido or amino group; Y has the same meaning as that of X in formula (I).

Compounds preferred for use as the magenta dye image forming coupler have the following formula (VI):

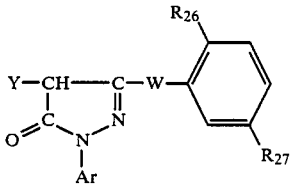

(VI)

wherein Ar is an aryl group; $R_{26}$ is a hydrogen atom, a halogen atom, an alkyl group or an alkoxy group; $R_{27}$ is an alkyl, amido, imido, N-alkylcarbamoyl, N-alkylsulfamoyl, alkoxycarbonyl, acyloxy, sulfonamido or urethane group; Y is the same as defined for formula (V); W is —NH—, —NHCO— (the N atom being bound to a carbon atom in the pyrazolone nucleus) of —NH-CONH—.

Such yellow and magenta couplers may be incorporated in emulsions either by the method already described in connection with the cyan coupler of the present invention or by any of the methods known in the art.

Typical and more specific examples of the yellow and magenta dye forming couplers that are preferably used in the present invention are listed below, but it should be understood that the scope of the invention is by no means limited to such examples.

Yellow couplers

Y-1

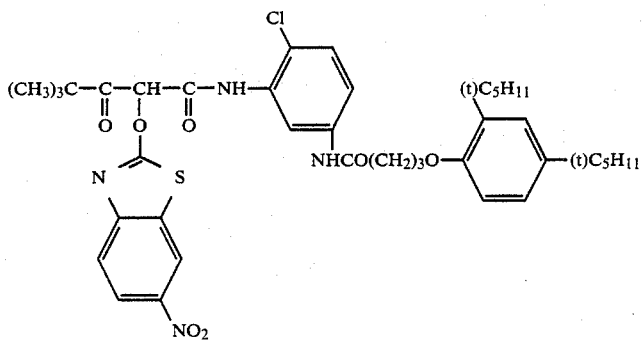

Y-2

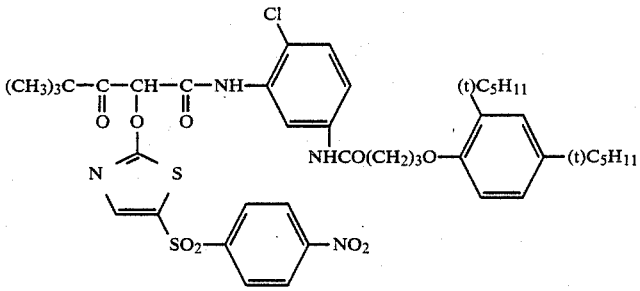

Y-3

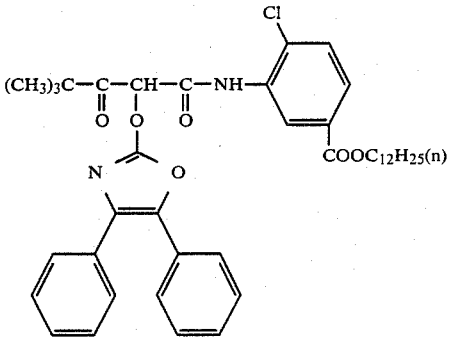

Y-4

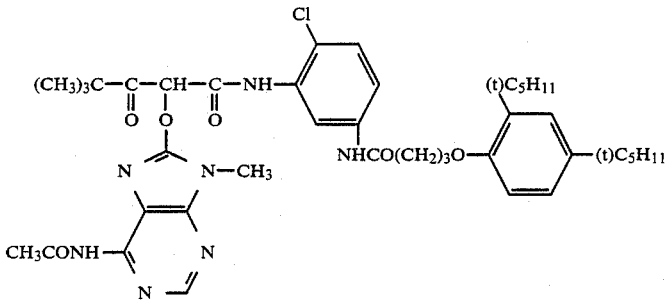

Y-5

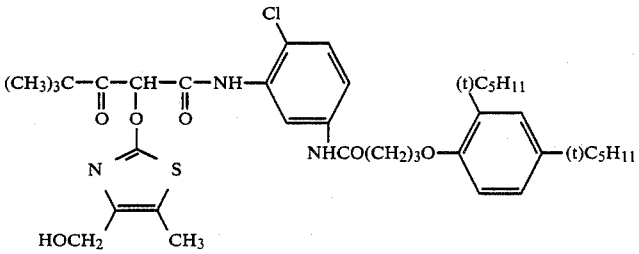

-continued
Y-6
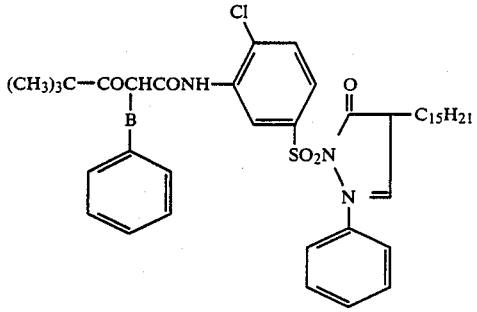
Y-7
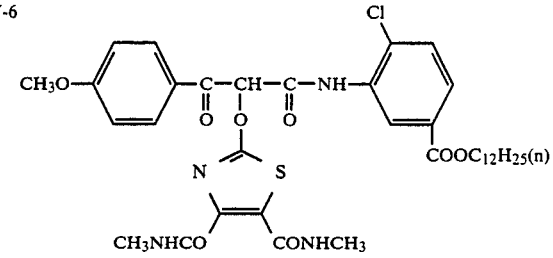
Y-8
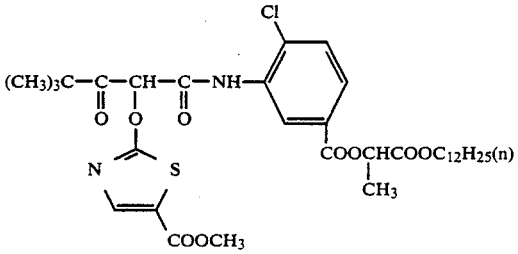
Y-9
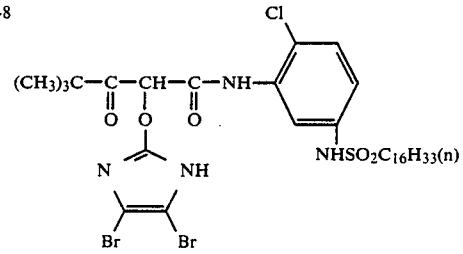
Y-10
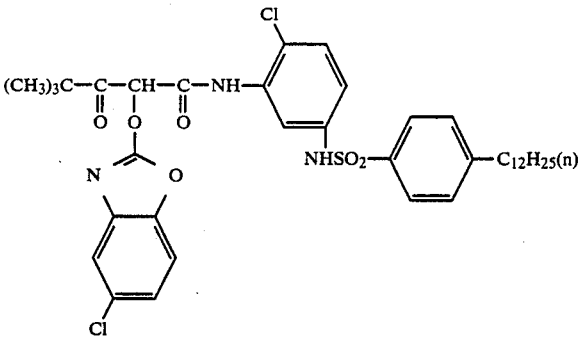
Y-11
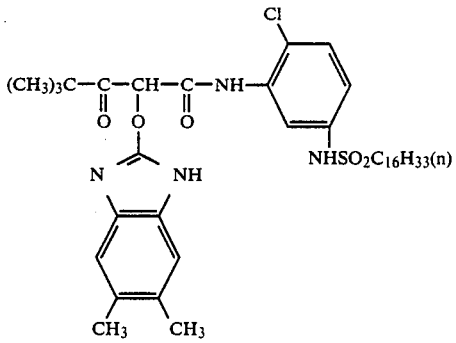
Y-12
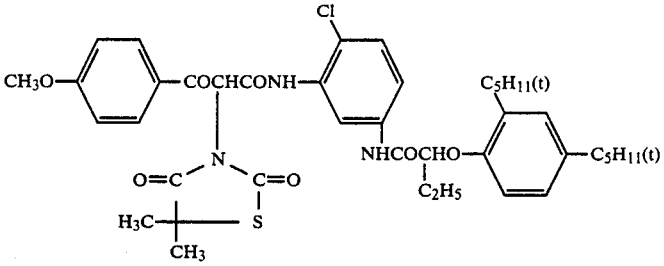
Y-13
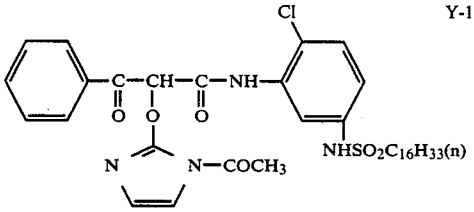
Y-14
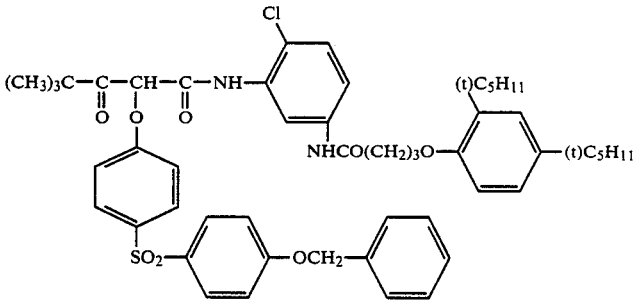
Magenta couplers -continued
M-1
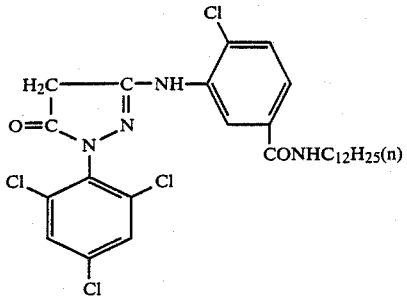
M-2
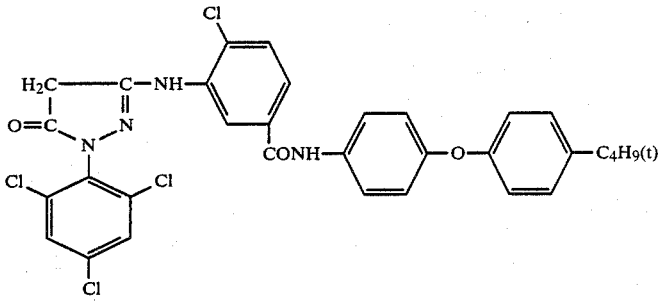
M-3
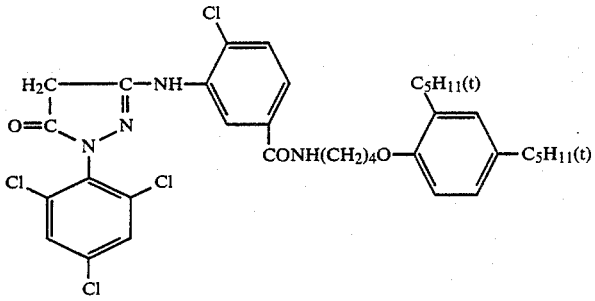
M-4
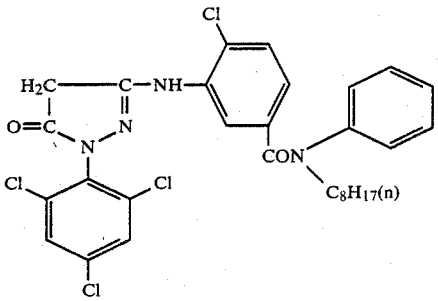
M-5
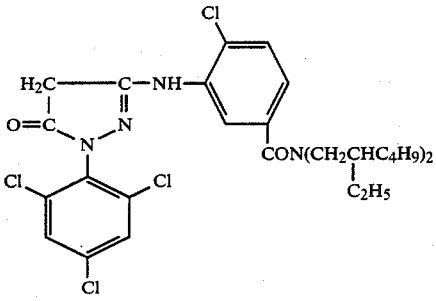
M-6
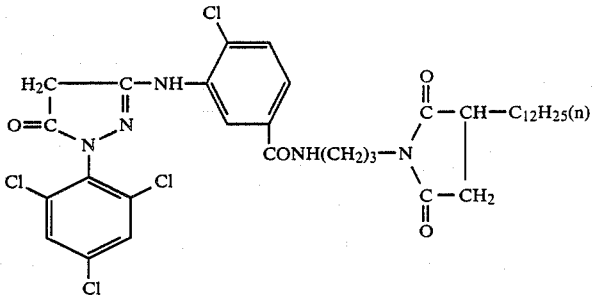
M-7
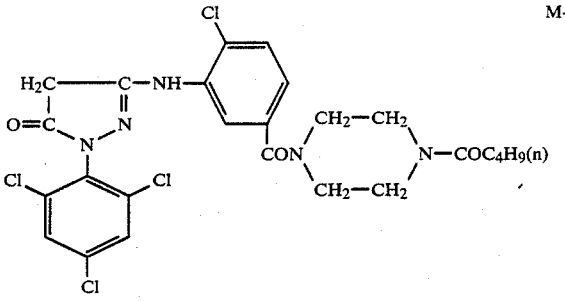
M-8
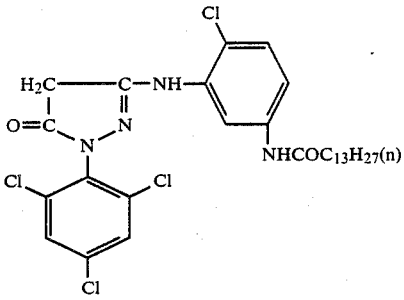
M-9
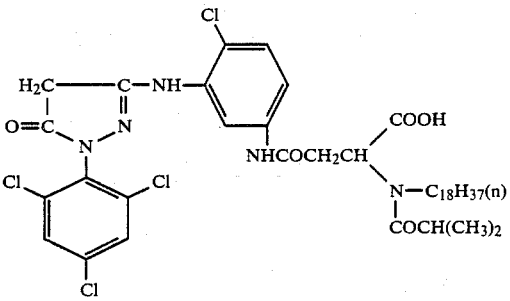

-continued
M-10
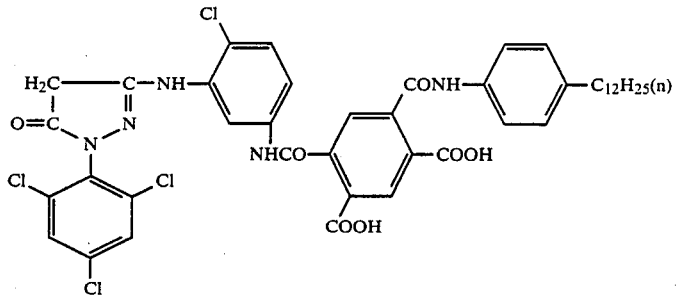
M-11
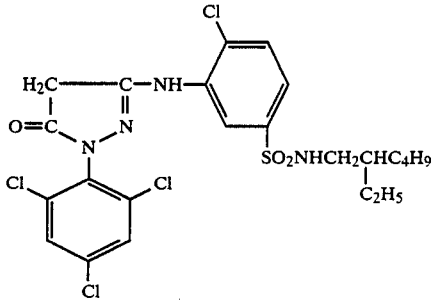
M-12
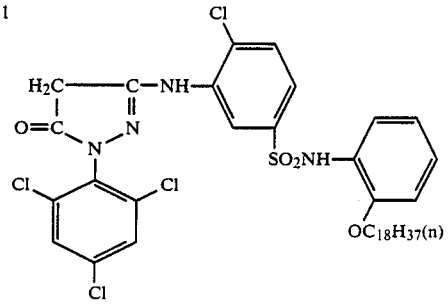
M-13
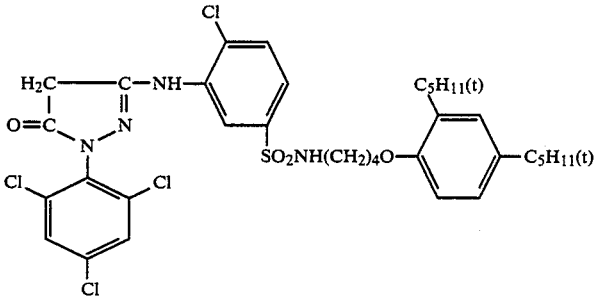
M-14
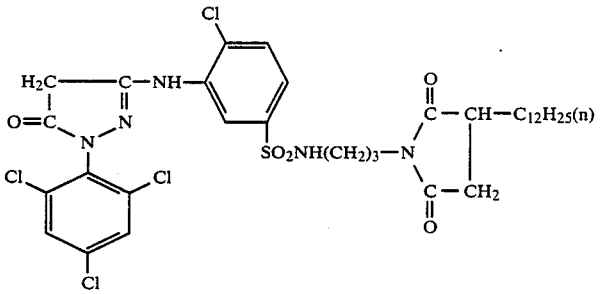
M-15
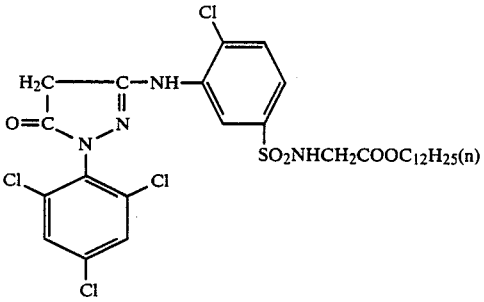
M-16
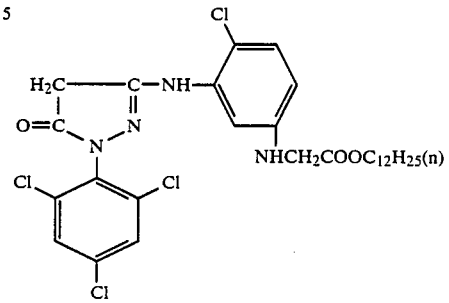

-continued
M-17
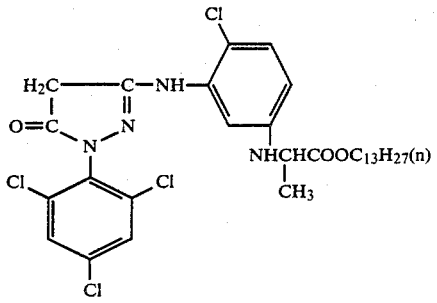
M-18
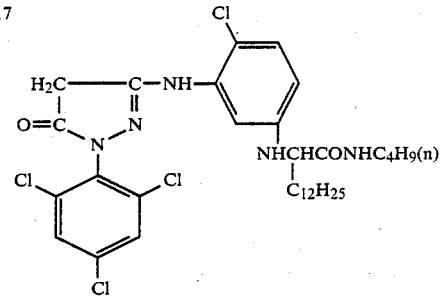
M-19
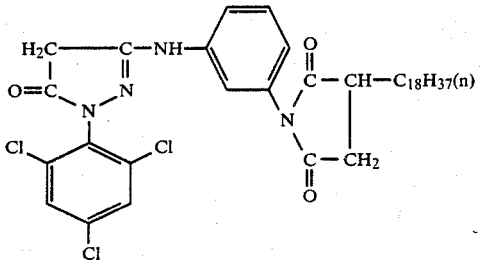
M-20
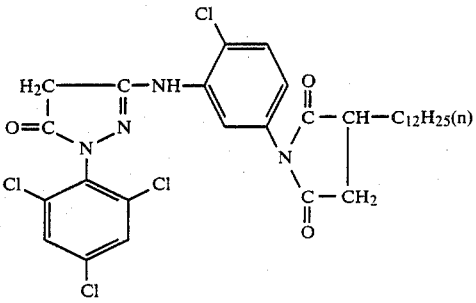
M-21
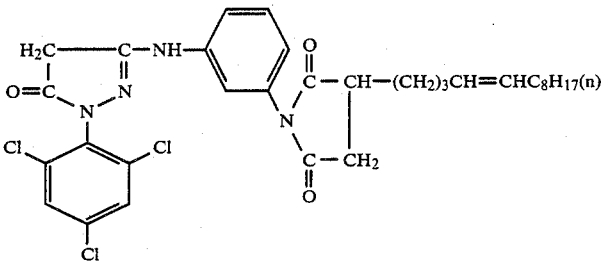
M-22
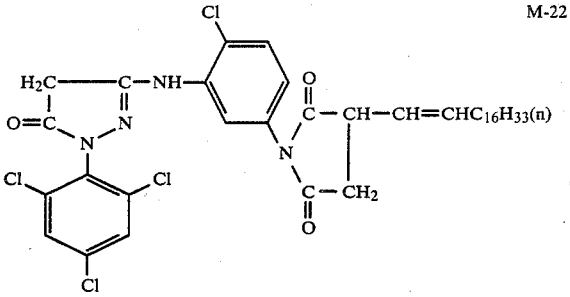
M-23
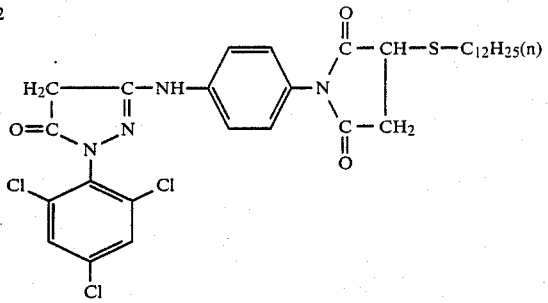
M-24
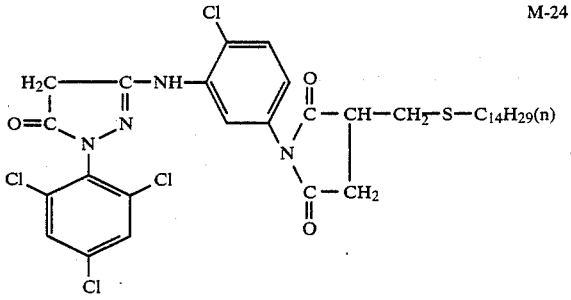
M-25
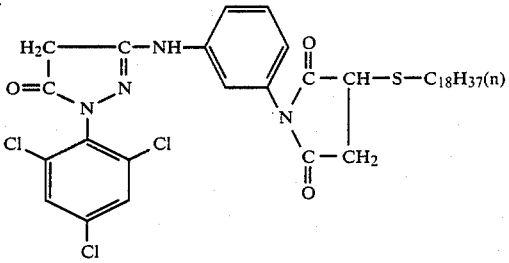

-continued
M-26
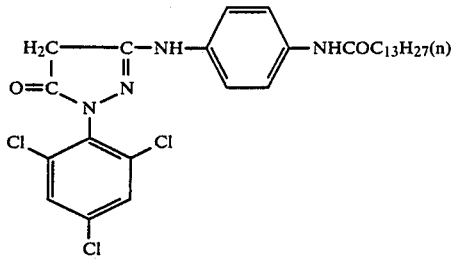
M-27
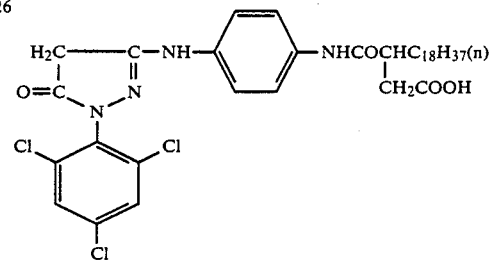
M-28
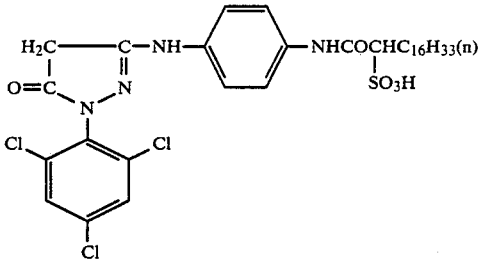
M-29
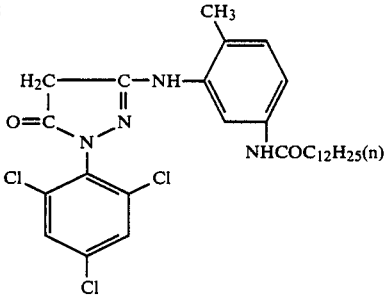
M-30
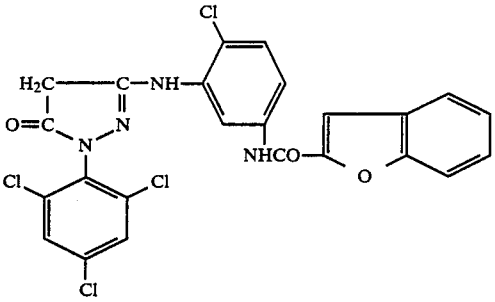
M-31
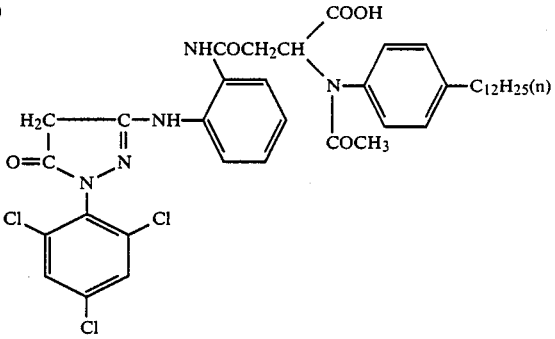
M-32
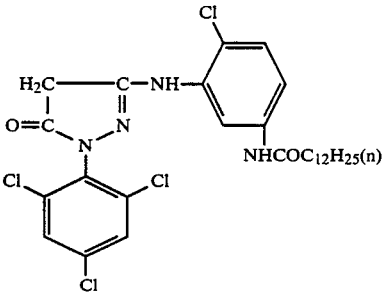
M-33
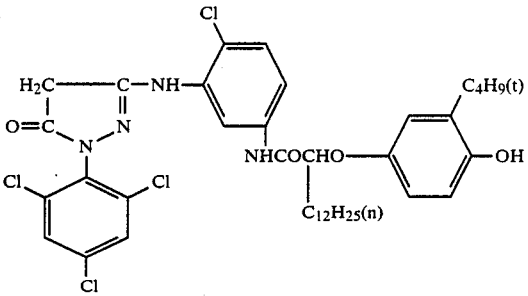
M-34
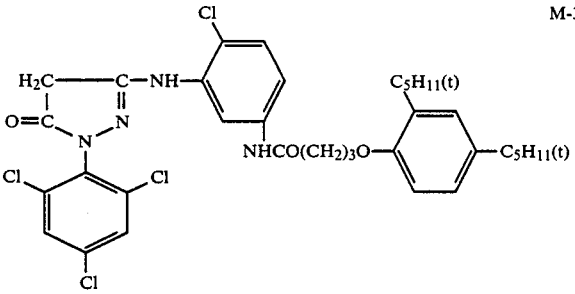
M-35
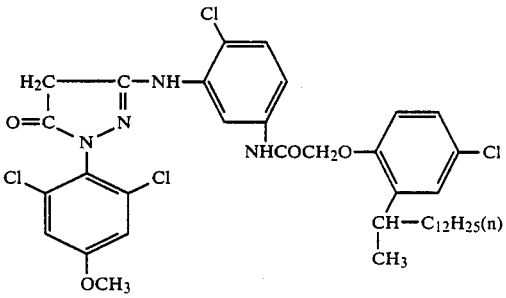

-continued
M-36
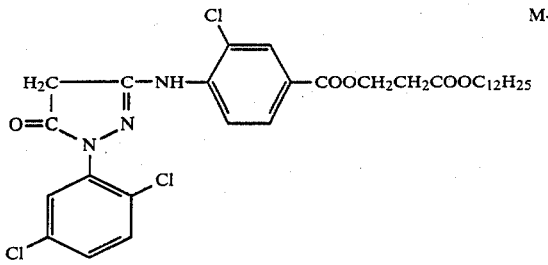
M-37
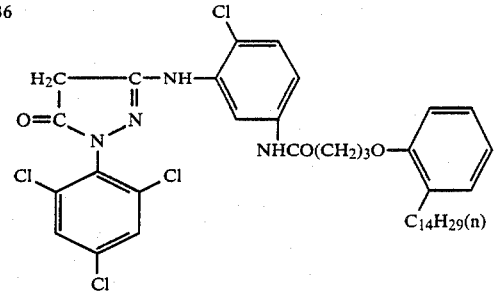
M-38
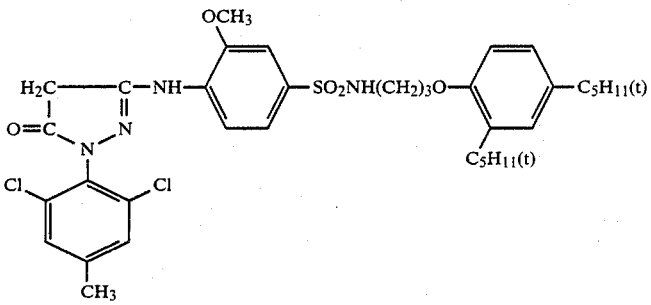
M-39
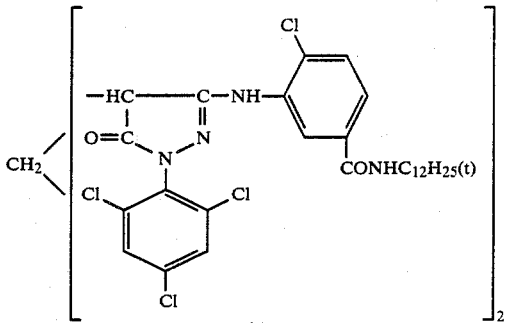
M-40
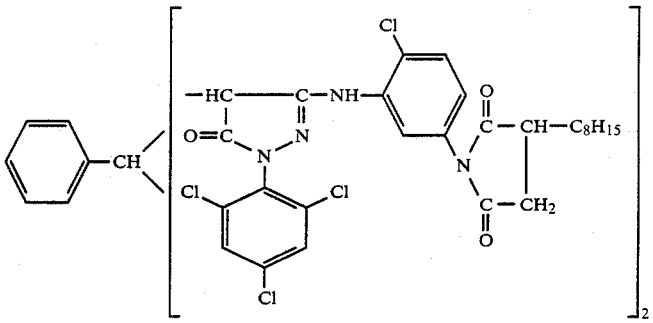
M-41
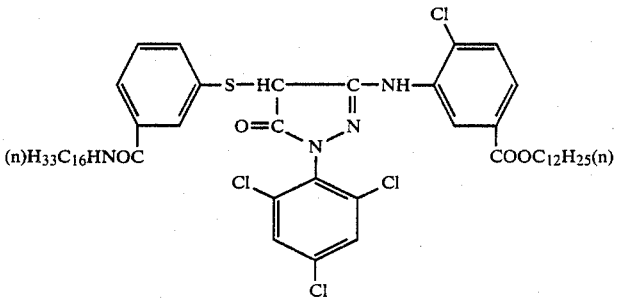

-continued

M-42

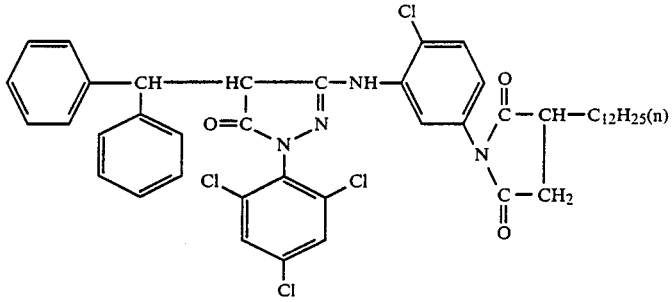

M-43

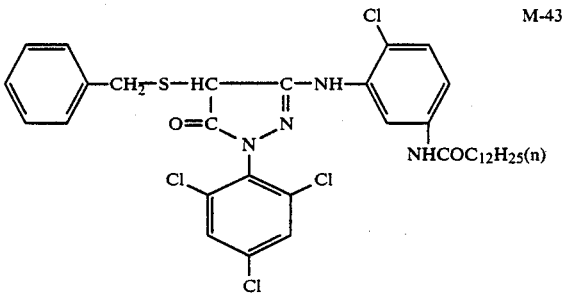

M-44

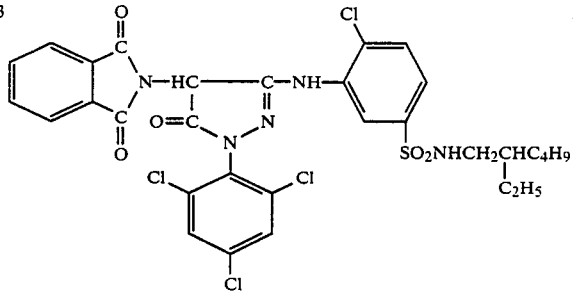

M-45

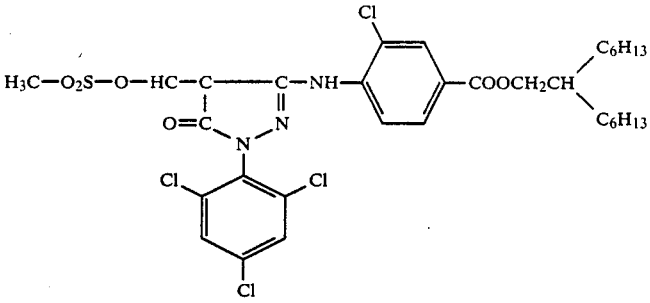

M-46

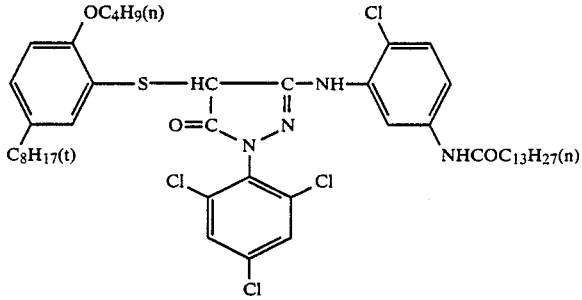

Each of these yellow and magenta dye forming couplers is incorporated in a silver halide emulsion layer in an amount of about 0.05–2 mols per mol of silver halide.

Examples of the support that can be used in the present invention include baryta paper, polyethylene coated paper, synthetic polypropylene paper, and a transparent support with a reflective layer or a reflector. A suitable support is properly selected depending upon the specific use of the silver halide photographic material prepared according to the present invention.

The silver halide emulsion layers and non-sensitive layers used in the present invention may be formed by any of the coating techiques including dip coating, air doctor coating, curtain coating and hopper coating.

Each of the silver halide emulsion layers according to the present invention may have incoporated therein any of the silver halides that are commonly employed in silver halide photographic materials, such as silver bromide, silver chloride, silver iodobromide, silver chlorobromide and silver chloroiodobromide. These silver halides may be used either as coarse or as fine grains, and the grain size distribution may be normal crystals ortwins, with the proportions of (100) and (111) planes being selected at suitable values. The crystals of the silver halide grains may have a homogeneous internal structure, or they may have different internal and surface structures. The silver halides may be of such a type that a latent image is principally formed on the surface or of such a type that the image is formed within the grain. Such silver halide grains may be prepared by either the neutral method, ammoniacal method or the acid method. Silver halide grains prepared by the double-jet method, single-jet method (either normal or reverse) or the conversion method.

The silver halide emulsions according to the present invention may be sensitized chemically. Chemical sensitizers that can be used in the present invention include sulfur sensitizers, selenium sensitizers, reduction sensitizers, and noble metal sensitizers. Illustrative sulfur sensitizers are arylthiocarbamide, thiourea, and cystine. Selenium sensitizers may be activated or inactive. Exemplary reduction sensitizers are stannous salts and polyamines. Usable nobel metal sensitizers include gold sensitizers (e.g. potassium aurithiocyanate, potassium chloroaurate, and 2-aurosulfobenzothiazole methyl chloride) and water-soluble palladium, platinum, ruthenium, rhodium or iridium salts (e.g. ammonium chloropalladate, potassium chloroplatinate and sodium chloropalladide). These chemical sensitizers may be used either singly or in combination.

The silver halide emulsions according to the present invention may have various known photographic additives incorporated therein.

The silver halides according to the present invention are spectrally sensitized with a suitable sensitizer in order to provide the red-sensitive emulsion with the necessary sensitivity in the proper spectral region. Various spectral sensitizers may be used either alone or in combination. Typical spectral sensitizers that can be used in the present invention with advantage are cyanine, merocycnine and composite cyanine dyes of the type shown in U.S. Pat. Nos. 2,270,378, 2,442,710 and 2,454,620.

The silver halide emulsion layers and non-sensitive layers in the silver halide color photographic material of the present invention may contain various other photographic additives such as antifoggants, anti-stain agents, brighteners, antistats, hardeners, plasticizers, wetting agents and UV absorbers.

The silver halide photographic material thus prepared according to the present invention is exposed and subsequently processed photographically by various techniques of color development. The color developer preferred for use in the present invention contains an aromatic primary amine compound as the principal color developing agent. Typical color developing agents are p-phenylenediamine compounds, such a diethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)-toluene, 2-amino-5-(N-ethyl-N-$\beta$-methanesulfonamidoethyl)aminotoluene sulfate, 4-(N-ethyl-N-$\beta$-methanesulfonamidoethylamino)aniline, 4-(N-ethyl-N-$\beta$-hydroxyethylamino)aniline and 2-amino-5-(N-ethyl-$\beta$-methoxyethyl)aminotoluene. These color developing agents may be used either alone or in combination. If necessary, they may be used in combination with a black-and-white developing agent such as hydroquinone. The color developer usually contains an alkali agent such as sodium hydroxide, ammonium hydroxide, sodium carbonate or sodium sulfite, and other additives such as an alkali metal halide (e.g. potassium bromide) and a development regulator (e.g. hydrazinic acid).

The color developing agent shown above that is present in a hydrophilic colloidal layer in the silver halide photographic material of the present invention may be incorporated as a precursor. The precursor is a compound that is capable of forming a color developing agent under alkaline conditions, and illustrative examples include a Schiff base with an aromatic aldehyde derivative, polyvalent metal ion complex, phthalylimide derivative, phosphorylamide derivative, sugar-amine reaction product, and urethane. More specific examples of the precursors for aromatic primary amine color developing agents are shown in U.S. Pat. Nos. 3,342,599, 2,507,114, 2,695,234, 3,719,492, British Pat. No. 803,783, Japanese Unexamined Published Patent Application Nos. 135,628/1978, 79,035/1979, as well as Research Disclosure No. 15,159, 12,146 and 13,924.

Such aromatic primary amine color developing agents or precursors therefor must be incorporated in amounts sufficient to provide adequate color formation during development. While the exact amount varies with the specific type of the photographic material to be processed, 0.1–5 moles, preferably 0.5–3 moles, of the color developing agent or its precursor are incorporated per mol of silver halide. The color developing agents and precursors therefor shown above may be used either alone or in combination. The compounds listed above may be incorporated in a photographic material after they are dissolved in a suitable solvent such as water, methanol, ethanol or acetone. Alternatively, a high-boiling organic solvent such as dibutyl phthalate, dioctyl phthalate or tricrresyl phosphate may be used to form an emulsion of the compound, which is then incorporated in the photographic material. If desired, a latex polymer impregnated with the compound may be incorporated as shown in Research Disclosure No. 14850.

After color development, the silver halide color photographic material of the present invention is usually bleached, fixed (sometimes bleach-fixed in a single step) and rinsed with water. While many compounds are used as bleaching agents, compounds of polyvalent metals such as iron (III), coblat (III) and tin (II) are preferred. Particularly suitable compounds are complex salts of such polyvalent cationic metals and organic acids, such as metal complex salts with aminopolycarboxylic acids (e.g. ethylenediaminetetraacetic acid, nitrilotriacetic acid, and N-hydroxyethylethylenediamine diacetic acid), malonic acid, tartaric acid, malic acid, diglycolic acid and dithioglycolic acid, as well as ferricyanate and bichromate salts. These compounds may be used either alone or in suitable combinations.

The silver halide photographic material of the present invention contains a cyan coupler in a stable dispersion and provides a dye image which retains its good photographic properties for an extended period of storage. The dye image produced by this photographic material has a good balance in resistance to light, heat and moisture and a particularly great improvement is achieved in resistance to Y stain and discoloration under exposure to light.

The advantages of the present invention are hereunder described in greater detail by reference to the following examples, to which the scope of the invention is by no means limited.

EXAMPLE 1

Multi-color photographic elements having the layer arrangement shown in Table 1 were prepared.

TABLE 1

| Layer No. and type | Silver deposit | Gelatin deposit | UV absorber deposit | Coupler type and deposit | High-boiling organic solvent |
|---|---|---|---|---|---|
| 6 Protective | — | 15 | — | — | — |
| 5 Red-sensitive emulsion | 3.0 | 20 | — | See Table 2 7.0 | See Table 2 5.0 |
| 4 Intermediate | — | 20 | 6.0 | — | DBP 5.0 |
| 3 Green-sensitive emulsion | 3.0 | 20 | — | (M-9) 6.1 | TCP 5.0 |
| 2 Intermediate | — | 10 | — | — | — |
| 1 Blue-sensitive emulsion | 4.0 | 20 | — | (Y-19) 10.0 | DBP 6.0 |
| Polyethylene coated paper support | | | | | |

In this table, the figures are in mg/100 $cm^2$, and DBP and TCP stand for dibutyl phthalate and tricresyl phosphate, respectively. The UV absorber was a mixture of UV-1 and UV-2 (see below) at a weight ratio of 3:1. The cyan coupler and high-boiling organic solvent used in the fifth layer were changed as shown in Table 2 to prepare sample Nos. 1 to 12.

Comparative cyan couplers 1 and 2 had the following structures:

Comparative coupler 1 (C-A)

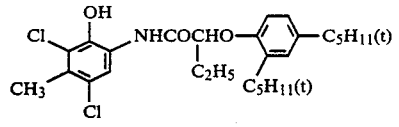

Comparative coupler 2 (C-B)

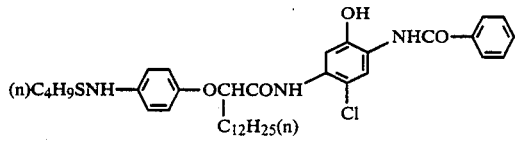

Each of the cyan coupler dispersions for incorporation in the fifth layer was prepared by the following procedure:

(a) Each of the cyan couplers listed in Table 2 (33 g), 2,5-di-t-octylhydroquinone (0.45 g), each of the high-boiling organic solvents shown in Table 2 (26.4 g) and ethyl acetate (60 g) were mixed and the resulting mixture was heated to 60° C. to form a solution.

(b) Photographic gelatin (40 g) and pure water (500 ml) were mixed at room temperature and the mixture was left to stand for 20 minutes to swell the gelatin. The mixture was then heated at 60° C. to form a solution. This solution was uniformly mixed under agitation with 50 ml of a 5% aqueous solution of Alkanol B (Du Pont).

(c)The solutions prepared in (a) and (b) were mixed and treated with an ultrasonic disperser for 30 minutes until a uniform dispersion formed.

UV absorbers

UV-1:

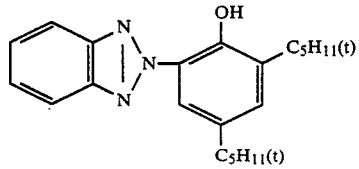

-continued

UV-2:

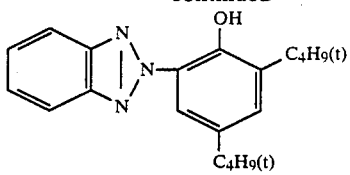

The twelve samples thus prepared were exposed to red light and subsequently processed by the scheme shown below. The samples having monochromatic cyan dye images were checked for their keeping quality by the procedures shown below.

| Processing scheme | Time | Temperature |
|---|---|---|
| Color development | 3.5 min | 33° C. |
| Bleach-fixing | 1.5 min | 33° C. |
| Rinsing | 3.0 min | 33° C. |
| Drying | — | 80° C. |
| Color developer formulation | | |
| Pure water | | 700 ml |
| Benzyl alcohol | | 15 ml |
| Diethylene glycol | | 15 ml |
| Hydroxylamine sulfate | | 2 g |
| N—ethyl-N—β-methanesulfonamidoethyl-3-methyl-4-aminoaniline sulfate | | 4.4 g |
| Potassium carbonate | | 30.0 g |
| Potassium bromide | | 0.4 g |
| Potassium chloride | | 0.5 g |
| Potassium sulfite | | 2 g |
| Water to make | | 1,000 ml |
| pH | | 10.20 |
| Bleach-fixing solution formulation | | |
| Ethylenediaminetetraacetic acid ammonium iron (III) salt | | 61 g |
| Ethylenediaminetetraacetic acid diammonium salt | | 5 g |
| Ammonium thiosulfate | | 125 g |
| Sodium metabisulfite | | 13 g |
| Sodium sulfite | | 2.7 g |
| Water to make | | 1,000 ml |
| pH | | 7.2 |
| Dye image keeping test | | |
| 1. Light discoloration | | |
| A. Xenon fade-Ometer | | $1.5 \times 10^5$ lux × 150 hr |
| B. Fluorescent lamp discoloration tester | | $1.6 \times 10^4$ lux × 800 hr |
| 2. Dark discoloration | | |
| C. 77° C. (no humidification) × 14 days | | |
| D. 70° C. (80% r.h.) × 14 days | | |

The keeping quality of the dye image is expressed in terms of percentage, ie, the density after testing (D) divided by the initial density (Do=1.0) times 100. The Y-stain under exposure to light is expressed in terms of the difference between the blue density ($D_B$) of the background before testing and that after testing. The degree of discoloration of the cyan dye image is expressed in terms of "percent P variation" which is defined by:

$$P(\%) = \frac{D_G}{D_R'} \times 100$$

wherein $D_R$, presents the red density after discoloration from the initial cyan density ($D_R$=0.5) and $D_G$ is the green density after discoloration.

TABLE 2

| Sample No. | Cyan coupler | High-boiling organic solvent | Di-electric constant | Light discoloration A: Percent residual dye | A: P (%) | A: Y stain under exposure to light | B: Percent residual dye | B: P (%) | B: Y stain under exposure to light | Dark discoloration C | Dark discoloration D |
|---|---|---|---|---|---|---|---|---|---|---|---|
| 1 Outside the scope of the present invention | Comparative coupler 1 | DBP | 6.4 | 55 | 95 | 0.28 | 72 | 62 | 0.17 | 65 | 67 |
| 2 Outside the scope of the present invention | Comparative coupler 1 | (H-2) | 5.1 | 57 | 92 | 0.28 | 73 | 58 | 0.17 | 65 | 67 |
| 3 Outside the scope of the present invention | Comparative coupler 2 | DBP | 6.4 | 35 | 214 | 0.39 | 58 | 162 | 0.24 | 97 | 98 |
| 4 Outside the scope of the present invention | Comparative coupler 2 | (H-2) | 5.1 | 35 | 209 | 0.38 | 59 | 153 | 0.24 | 98 | 99 |
| 5 Outside the scope of the present invention | C-1 | DBP | 6.4 | 56 | 116 | 0.35 | 73 | 69 | 0.21 | 92 | 94 |
| 6 Sample of the present invention | C-1 | (H-2) | 5.1 | 67 | 45 | 0.25 | 79 | 39 | 0.14 | 100 | 100 |
| 7 Outside the scope of the present invention | C-4 | DBP | 6.4 | 55 | 125 | 0.36 | 72 | 68 | 0.21 | 91 | 94 |
| 8 Sample of the present invention | C-4 | (H-2) | 5.1 | 66 | 46 | 0.26 | 79 | 40 | 0.15 | 99 | 100 |
| 9 Sample of the present invention | C-8 | (H-6) | 4.6 | 65 | 45 | 0.26 | 78 | 41 | 0.15 | 98 | 99 |
| 10 Sample of the present invention | C-10 | (H-7) | 4.5 | 64 | 45 | 0.26 | 78 | 40 | 0.15 | 99 | 98 |
| 11 Sample of the present invention | C-14 | (H-12) | 5.1 | 64 | 48 | 0.27 | 79 | 43 | 0.16 | 98 | 99 |
| 12 Sample of the present invention | C-17 | (H-13) | 4.5 | 65 | 47 | 0.26 | 78 | 42 | 0.15 | 100 | 100 |

As Table 2 shows, sample Nos. 1 and 2 using comparative cyan coupler 1 exhibited little improvement in their resistance to Y stain under exposure to light, as well as in light and dark discolorations although sample No. 2 used a high-boiling organic solvent according to the present invention. Sample Nos. 3 and 4 using comparative cyan coupler 2 displayed an appreciable improvement in resistance to dark discoloration, but their resistance to light discoloration and Y-stain under exposure to light was very low. The high-boiling organic solvent according to the present invention showed substantially no effectiveness in eliminating these defects. Sample Nos. 6, 8 to 12 using the cyan couplers according to the present invention displayed a substantial improvement in their resistance to dark discoloration and, at the same time, they had a significantly improved resistance to light discoloration and to Y stain under exposure to light. However, sample Nos. 5 and 7 using a high-boiling organic solvent outside the scope of the present invention did not have good resistance to light discoloration or Y stain under exposure to light. The data in Table 2 therefore verifies the combined effect of the cyan coupler and the high-boiling organic solvent according to the present invention. Sample Nos. 6, 8 to 12 according to the present invention were also characterized by the high stability of cyan coupler dispersions and caused no precipitation or other troubles. The sensitometric characteristics of these samples were as good as those of comparative sample No. 1. Comparison in terms of "percent P variation" reveals that the samples of the present invention were appreciably improved in the resistance of cyan dye to light discoloration.

EXAMPLE 2

Multi-color photographic elements having the layer arrangement shown in Table 3 were prepared.

TABLE 3

| Layer No. and type | Silver deposit | Gelatin deposit | UV absorber deposit | Coupler type and deposit | High-boiling organic solvent |
|---|---|---|---|---|---|
| 7 Protective | — | 10 | — | — | — |
| 6 UV absorber | — | 10 | 4.0 | — | DBP 3.3 |
| 5 Red-sensitive emulsion | 3.0 | 20 | — | See Table 4 7.0 | See Table 4 5.0 |
| 4 Intermediate | — | 20 | 6.0 | — | DBP 5.0 |
| 3 Green-sensitive emulsion | 3.0 | 20 | — | (M-9) 6.1 | TCP 5.0 |
| 2 Intermediate | — | 10 | — | — | — |
| 1 Blue-sensitive emulsion | 4.0 | 20 | — | (Y-19) 10.0 | DBP 6.0 |
| Polyethylene coated paper support | | | | | |

Seven samples were prepared by using the cyan couplers and high-boiling organic solvents shown in Table 4. Their image keeping quality was examined as in Example 1 and the results are summarized in Table 4.

TABLE 4

| Sample No. | Cyan coupler | High-boiling organic solvent | Light discoloration A: Percent residual dye | A: P (%) | A: Y stain under exposure to light | B: Percent residual dye | B: P (%) | B: Y stain under exposure to light | Dark discoloration C | Dark discoloration D |
|---|---|---|---|---|---|---|---|---|---|---|
| 13 Outside the scope of the present invention | Comparative coupler 1 | DBP | 61 | 95 | 0.28 | 74 | 62 | 0.17 | 65 | 67 |
| 14 Outside the scope of the present invention | Comparative coupler 2 | DBP | 42 | 214 | 0.36 | 62 | 162 | 0.22 | 97 | 98 |

TABLE 4-continued

| Sample No. | Cyan coupler | High-boiling organic solvent | Light discoloration A: Percent residual dye | Light discoloration A: P (%) | Light discoloration A: Y stain under exposure to light | Light discoloration B: Percent residual dye | Light discoloration B: P (%) | Light discoloration B: Y stain under exposure to light | Dark discoloration C | Dark discoloration D |
|---|---|---|---|---|---|---|---|---|---|---|
| 15 Outside the scope of the present invention | C-1 | DBP | 73 | 52 | 0.33 | 78 | 48 | 0.18 | 92 | 94 |
| 16 Sample of the present invention | C-1 | (H-2) | 81 | 34 | 0.23 | 85 | 35 | 0.12 | 100 | 100 |
| 17 Sample of the present invention | C-4 | (H-2) | 82 | 35 | 0.24 | 85 | 34 | 0.13 | 99 | 100 |
| 18 Sample of the present invention | C-8 | (H-6) | 80 | 35 | 0.25 | 84 | 35 | 0.13 | 98 | 99 |
| 19 Sample of the present invention | C-10 | (H-7) | 81 | 37 | 0.25 | 85 | 36 | 0.14 | 99 | 98 |

The table shows that samples 16 to 19 prepared according to the present invention were far superior to comparative samples 13 to 15 in terms of resistance to light discoloration, dark discoloration and Y-stain under exposure to light.

What is claimed is:

1. A silver halide photographic material having one or more silver halide emulsion layers formed on a support, wherein at least one of said silver halide emulsion layers contains at least one cyan coupler of Formula (I) dispersed therein with the aid of a high-boiling organic solvent having a dielectric constant of not more than 6.0:

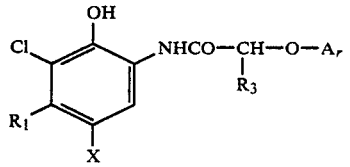

(I)

wherein $R_1$ is a straight-or branched-chain alkyl group having 2 to 4 carbon atoms; X is a hydrogen atom or a group capable of leaving upon coupling reaction; $R_3$ is a hydrogen atom or an alkyl group having 1 to 12 carbon atoms; and Ar is an aryl group.

2. A silver halide photographic material according to claim 1, wherein said high-boiling organic solvent is at least one selected from among phthalate and phosphate esters.

3. A silver halide photographic material according to claim 2, wherein said phthalate ester is represented by the following formula:

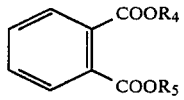

wherein $R_4$ and $R_5$ are each an alkyl group, an alkenyl group or an aryl group, provided that the total number of carbon atoms of the groups represented by $R_4$ and $R_5$ is from 8 to 32.

4. A silver halide photographic material according to claim 3, wherein the total number of carbon atoms of the groups represented by $R_4$ and $R_5$ in said formula is from 16 to 24.

5. A silver halide photographic material according to claim 2, wherein said phosphate ester is represented by the following formula:

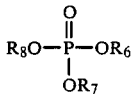

wherein $R_6$, $R_7$ and $R_8$ are each an alkyl group, an alkenyl group or an aryl group, provided that the total number of carbon atoms of the groups represented by $R_6$, $R_7$ and $R_8$ is from 24 to 54.

6. A silver halide photographic material according to claim 1, which comprises, in sequence on the support, a yellow coupler—containing blue-sensitive silver halide emulsion layer, a magenta coupler—containing green-sensitive silver halide emulsion layer and a cyan coupler—containing red-sensitive silver halide emulsion layer.

* * * * *